US011021805B2

(12) United States Patent
Pfeiffer

(10) Patent No.: US 11,021,805 B2
(45) Date of Patent: Jun. 1, 2021

(54) METHOD FOR THE PRODUCTION OF ELECTROPLATED COMPONENTS

(71) Applicant: FRAUNHOFER-GESELLSCHAFT ZUR FÖRDERUNG DER ANGEWANDTEN FORSCHUNG E. V., Munich (DE)

(72) Inventor: Wulf Pfeiffer, Teningen (DE)

(73) Assignee: Fraunhofer-Gesellschaft zur förderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/677,536

(22) Filed: Nov. 7, 2019

(65) Prior Publication Data

US 2020/0149177 A1 May 14, 2020

(30) Foreign Application Priority Data

Nov. 9, 2018 (DE) ..... 10 2018 219 181.6

(51) Int. Cl.

| | |
|---|---|
| ***C25D 3/04*** | (2006.01) |
| ***C25D 3/12*** | (2006.01) |
| ***C25D 3/20*** | (2006.01) |
| ***C25D 3/22*** | (2006.01) |
| ***C25D 3/26*** | (2006.01) |
| ***C25D 3/46*** | (2006.01) |
| ***C25D 3/48*** | (2006.01) |
| ***C25D 5/34*** | (2006.01) |
| ***C25D 5/54*** | (2006.01) |
| ***C25D 5/22*** | (2006.01) |

(52) U.S. Cl.

CPC ..... *C25D 5/22* (2013.01); *C25D 3/04* (2013.01); *C25D 3/12* (2013.01); *C25D 3/20* (2013.01); *C25D 3/22* (2013.01); *C25D 3/26* (2013.01); *C25D 3/46* (2013.01); *C25D 3/48* (2013.01); *C25D 5/34* (2013.01); *C25D 5/54* (2013.01)

(58) Field of Classification Search

CPC ..... C25D 5/34; C25D 5/22; C25D 5/36

See application file for complete search history.

(56) References Cited

U.S. PATENT DOCUMENTS

| | | | |
|---|---|---|---|
| 9,702,044 | B2 | 7/2017 | Banno et al. |
| 9,938,600 | B2 | 4/2018 | Muhr et al. |
| 2015/0037512 | A1 | 2/2015 | Banno et al. |
| 2015/0337406 | A1 | 11/2015 | Muhr et al. |
| 2016/0122889 | A1 | 5/2016 | Muhr et al. |
| 2017/0283953 | A1 | 10/2017 | Banno et al. |

FOREIGN PATENT DOCUMENTS

| | | | |
|---|---|---|---|
| DE | 156 568 | A | 6/1903 |
| DE | 199 36 082 | A1 | 2/2001 |
| DE | 112012004983 | T5 | 9/2014 |
| DE | 102013010025 | A1 | 12/2014 |
| EP | 1 920 088 | B1 | 6/2013 |
| EP | 2 949 787 | A2 | 12/2015 |

OTHER PUBLICATIONS

Friede et al., "Wasserstoffversprüdung einfach und sicher bestimmen," ("Determine hydrogen embrittlement easily and reliably"), *JOT Journal für Oberflüchentechnik* 47(4): XII-XVI (2007)—Abstract only.

German Patent Office, Office Action in German Patent Application No. 10 2018 219 181.6 (dated May 29, 2019).

*Primary Examiner* — Brian W Cohen

(74) *Attorney, Agent, or Firm* — Leydig, Voit & Mayer, Ltd.

(57) ABSTRACT

Disclosed is a method for the production of electroplated components. In the disclosed method, an edge layer of a component to be coated is subjected to a mechanical treatment in which the edge layer is deformed at least in portions, consequently the structure of the edge layer being modified at least in portions and hydrogen traps being produced in the modified portions of the edge layer.

15 Claims, No Drawings

METHOD FOR THE PRODUCTION OF ELECTROPLATED COMPONENTS

CROSS-REFERENCE TO RELATED APPLICATIONS

This patent application claims the benefit of German Patent Application No. 10 2018 219 181.6, filed on Nov. 9, 2018, the disclosure of which is incorporated herein by reference in its entirety for all purposes.

The present invention relates to a method for the production of electroplated components. In the method according to the invention, an edge layer of a component to be coated is subjected to a mechanical treatment in which the edge layer is deformed at least in portions, consequently the structure of the edge layer being modified at least in portions and hydrogen traps being produced in the modified portions of the edge layer. Subsequently, a coating is electrodeposited at least on a part of the surface of the mechanically treated edge layer of the component to be coated, hydrogen being released during the electrodeposition which penetrates into the mechanically treated edge layer at least partially. According to the invention, the hydrogen traps produced in the modified portions of the edge layer essentially bind the totality of the hydrogen penetrating into the mechanically treated edge layer during the electrodeposition in step b). In this way, damage to the component resulting from hydrogen embrittlement can be avoided, which leads to improved strength properties of the component, in particular to an increased yield strength or a reduced brittleness, longer lasting stability and also higher longevity of the component. In addition, the present invention relates also to a component which can be produced with the method according to the invention and also to the use of such a component.

Electroplating of components with the purpose of corrosion- or wear protection is in many cases an indispensable and often last step of component production processes. As a result of the electrochemical operating principles of electroplating processes, also atomic hydrogen is always released as by-product. Under specific boundary conditions, atomic hydrogen can penetrate easily into the material to be coated and, for example in high-strength steels but also in many other metallic alloys, can lead there to the dreaded hydrogen embrittlement. Hydrogen embrittlement can be manifested in a temporally delayed, unexpected component failure or even in failure significantly below the yield- or strength limit, or in a reduced number of alternating stresses (fluctuating stress).

Component damage due to hydrogen embrittlement requires the simultaneous presence of the following three boundary conditions:

- diffusible hydrogen in the material structure in a sufficient quantity
- stress due to significant external or internal tensile stresses
- hydrogen-sensitive material.

Correspondingly, with reference to the layer electrodeposition, the following available measures for reducing or avoiding the effect of hydrogen embrittlement have been applied to date:

- use of inhibitors for reducing the hydrogen input, such as e.g. described in Friede et al. (I. Friede, P. Hülser, "Determining hydrogen embrittlement simply and reliably", JOT 4, 2007)
- heat treatment after the layer deposition for expelling the hydrogen which has penetrated into the material structure, such as e.g. described in SAE AMS2406N, Plating, Chromium Hard Deposit, 2015
- introduction of intrinsic pressure stresses which counteract the subsequent stress due to tensile stresses, as e.g. described in Friede et al. and also in SAE AMS2406N, Plating, Chromium Hard Deposit, 2015.

However these solutions so far have various disadvantages.

Since the effectiveness of inhibitors is limited, there must take place, for example in the case of components made of high-strength steels, a heat treatment directly following the layer deposition. Increased temperatures release hydrogen which is less securely bound in the hydrogen traps, increase the diffusibility (moveability) of the hydrogen in the material structure and facilitate effusion of the hydrogen.

As a result of limiting the heat treatment temperatures and times in order to avoid undesired structure- and strength changes (in the case of high-strength steels, typically 190° C.-210° C.), adequate expulsion of hydrogen is not always present. In addition, the heat treatment is intended to be effected as quickly as possible after the coating in order to prevent recombination of the atomic hydrogen to molecular hydrogen, with the concomitant danger of blister formation, or diffusion into strength-influencing structural regions in the volume. This cannot always be observed with larger components. Also the normal practice of, for example, temperature-controlling zinc electroplated connecting elements for 4 hours at approx. 190° C., is inadequate for extracting hydrogen because zinc is an effective barrier for the hydrogen diffusion. It has been shown that a temperature duration of 4 hours can even be disadvantageous and can lead to occasional failures.

The use of inhibitors and the use of heat-treatment methods are therefore often inadequate for reliably excluding hydrogen embrittlement.

In the case of uncertain hydrogen influence, the effectiveness of inhibitors must be demonstrated by accompanying coating tests on sample material or the success of the heat treatment by complex strength tests. Tests on separate sample material with geometry and material volume deviating from the component cannot however always ensure reliable exclusion of hydrogen embrittlement in the component if diffusion paths and -times, structure-, deformation- and intrinsic stress states, are not identical.

Therefore in some cases of high-stressed components, it is attempted to counteract the subsequent operating stress due to tensile stresses by introducing intrinsic pressure stresses in component regions close to the surface and hence to prevent the production and propagation of cracks in the edge layer possibly embrittled by hydrogen. A typical method is shot peening. Shot peening before electroplating is applied preferably on fluctuation-stressed components and is not restricted to rotation-symmetrical geometries. It is widely used in the air travel sphere and is prescribed there necessarily for high-strength, hard-chrome plated components. In EP 1 920 088, a shot peening method was also reported for already coated components, which pursues the aim in addition of producing favourable intrinsic stresses also in the layer.

Reducing the effect of hydrogen embrittlement by shot peening is however not fail-safe due to two factors: firstly, typically significant intrinsic pressure stresses are built up only to at most 0.2 mm depth. In addition, these intrinsic pressure stresses can be reduced again partially or extensively in the course of fluctuating stress.

Hence, no satisfactory method is known to date with which hydrogen embrittlement can be avoided or significantly reduced effectively and long-term in electroplated components.

Starting herefrom, it is the object of the present invention to indicate a method for the production of electroplated components, in which the danger of damage by hydrogen embrittlement is reduced, and hence a reduction in the yield- or strength limit of the electroplated component caused by hydrogen or a reduction in the supportable alternating stresses (fluctuating stress) is counteracted.

This object is achieved by the method for the production of electroplated components, by the features of the electroplated component described herein and the advantageous developments thereof. Use of the electroplated component according to the invention are also described.

According to the invention, a method for the production of electroplated components is hence described, in which a) an edge layer of a component to be coated is subjected to a mechanical treatment, in which the edge layer is deformed at least in portions, consequently the structure of the edge layer being modified at least in portions and, in the modified portions of the edge layer, hydrogen traps being produced, and b) at least on a part of the surface of the mechanically treated edge layer of the component to be coated, a coating is electrodeposited, hydrogen being released during the electrodeposition which penetrates into the mechanically treated edge layer at least partially, the hydrogen traps produced in the modified portions of the edge layer essentially binding the totality of the hydrogen penetrating into the mechanically treated edge layer during the electrodeposition in step b).

As a result of the fact that the hydrogen traps produced in the modified portions of the edge layer essentially bind the totality of the hydrogen penetrating into the mechanically treated edge layer during the electrodeposition in step b), it is achieved that this hydrogen cannot continue to penetrate into the component, rather instead remains in the edge layer. In other words, it can hence be achieved that the hydrogen does not pass into the central regions which are crucial for the stability of the component. In these regions, the danger of hydrogen embrittlement is hence significantly reduced. As a result, the component has longer lasting stability and higher longevity.

In step a) of the method according to the invention, a pre-treatment of the component to be electroplated is implemented before the electroplating. An edge layer of the component to be coated is hereby subjected to a mechanical treatment. There is thereby understood by an edge layer, a layer-shaped region of the component which is situated at the edge of the component and extends preferably essentially parallel to the edge of the component. During the mechanical treatment, the edge layer is deformed at least in portions. The mechanical treatment applied according to the invention in step a) has the aim of modifying the structure of the edge layer, i.e. the atomic structure or the crystal structure of the material in the edge layer, at least in portions. In other words, the atomic structure or the crystal structure in the edge layer is changed at least in portions. The structure modification can comprise grain refining, an increase in dislocation density (i.e. increase in density of imperfections in the ordered crystal structure), and/or production of shear steps (shearing in or between grains). In particular, dislocations can be produced in the structure modification, i.e. defects in the atomic structure or in the crystal structure.

Furthermore, because of the mechanical treatment or the deformation, at least in portions, in step a), hydrogen traps are produced in the modified portions of the edge layer. Hydrogen traps thereby concern special structural elements in the atomic structure or in the crystal structure of a material in which hydrogen can be bound, preferably permanently. As hydrogen traps, there are possible primarily dislocations, grain limits (grain refinement, production of grain twins), shear steps and also other changes or modifications, caused by the deformation, at least in portions, in the atomic structure or crystal structure. In addition, hydrogen traps can be produced, e.g. also by conversions of metastable states, e.g. in steel: residual austenite into martensite. The capability of hydrogen traps to trap hydrogen, to retain or bind it, can be quantified by the binding energy thereof. For this purpose, the material is heated and it is observed at what temperature the trap again releases the hydrogen.

The modification of the structure of the edge layer, at least in portions, can also be accompanied by strengthening of the edge layer, at least in portions. A material change in the metal machining and metal processing is characterised by such a strengthening, which leads to increased strength or even increased hardness which is detectable by means of technical tests, inter alia as an increased resistance to residual deformations. Current methods for determining hardness are hardness tests according to Vickers (DIN EN ISO 6507) or Rockwell (DIN EN ISO 6508).

In step b), finally the electroplating of the component pre-treated in step a) finally is effected. A coating is hereby electrodeposited at least on a part of the surface of the mechanically treated edge layer of the component to be coated. During this electrodeposition, hydrogen is released which penetrates into the mechanically treated edge layer, at least partially. As a rule, only a small part of the released hydrogen hereby penetrates into the edge layer. According to the invention, the hydrogen traps produced in the modified portions of the edge layer essentially bind the totality of the hydrogen penetrating into the mechanically treated edge layer during the electrodeposition in step b).

There should thereby be understood by the term "essentially" in the description of "essentially the totality of the hydrogen penetrating into the mechanically treated edge layer during the electrodeposition in step b)", that it is possible that minimal quantities of the hydrogen penetrating into the mechanically treated edge layer during the electrodeposition in step b) are not bound by the hydrogen traps and remain diffusible. This hereby concerns non-critical concentrations of hydrogen, i.e. such small quantities of hydrogen which are so non-critical that they do not lead to hydrogen embrittlement. Preferably, such a non-critical concentration is at ≤2 ppm, particularly preferably at ≤1 ppm, very particularly preferably at ≤0.5 ppm. In other words it is preferred that the concentration of the (atomic and/or molecular) hydrogen which is present in the electroplated component and is not bound in the hydrogen traps, is at most 2 ppm, preferably at most 1 ppm, particularly preferably at most 0.5 ppm. In other words, the concentration of the diffusible hydrogen in the material volume is preferably at most 2 ppm, further preferably at most 1 ppm, particularly preferably at most 0.5 ppm.

The fact that the hydrogen traps produced in the modified portions of the edge layer essentially bind the totality of the hydrogen penetrating into the mechanically treated edge layer during the electrodeposition in step b), can be achieved by the total volume of the hydrogen traps produced in step a) being large enough to bind the quantity of hydrogen penetrating into the mechanically treated edge layer during the electrodeposition in step b). This total volume of the hydrogen traps can also be influenced by the mechanical treatment in step a). The precise achievement of such an influence is thereby dependent upon the chosen form of mechanical treatment. If the mechanical treatment is effected for example by means of shot peening, the parameters of the shot peening treatment are chosen, e.g. such that an adequate dislocation density is produced to adequate depths. Normal available peening parameters are hereby for example the diameter of the peening shot, the speed of the impinging shot and the exposure time. If the mechanical treatment is effected for example by deep rolling, an influence can be exerted, e.g. by varying the radius of the deep roller tool, the contact pressure, the overlapping of the roller tracks and the number of repeated passes. If the mechanical treatment is effected, for example by metal-removing machining (e.g. by grinding, turning, milling), an influence can be exerted, by means of the cooling conditions, the sharpness of the cutting elements and suitable combinations of delivery and feed, such as e.g. a preferred deformation with the consequence of increased dislocation densities. Optimal treatment- or machining parameters can thereby be differentiated clearly from the parameters which are used otherwise for example to produce intrinsic pressure stresses during shot peening or to increase the machining efficiency.

The exact value of the total volume of the hydrogen traps is dependent upon the electroplating to be implemented in step b) and therefore varies according to the respective application of the electroplated component to be produced.

In order to achieve that the hydrogen traps have a sufficiently large total volume in order to bind the required quantity of hydrogen, for example firstly the quantity of hydrogen penetrating into the mechanically treated edge layer during the electrodeposition in step b) can be estimated and subsequently the mechanical treatment can be implemented in step a) such that hydrogen traps with a sufficient total volume are produced. Alternatively, also the volume of the hydrogen penetrating into the mechanically treated edge layer during the electrodeposition in step b), can be determined, e.g. by experimental pre-tests, and the mechanical treatment in step a) can then be implemented such that the total volume of the hydrogen traps produced in the modified portions of the edge layer is greater than or at least equal to this determined volume of hydrogen.

In principle, however also estimation or determination of the quantity of hydrogen penetrating into the mechanically treated edge layer during the electrodeposition in step b) can be dispensed with if the mechanical treatment in step a) is implemented such that hydrogen traps with a very large total volume, adequate in any case, are produced.

With the method according to the invention, it can be achieved that the hydrogen produced during the electroplating and penetrating partially into the component is bound essentially completely in the edge layer of the component and hence cannot lead to hydrogen embrittlement in the regions of the component which are important for stability of the component. The proportion of diffusible hydrogen initiating the hydrogen embrittlement can hence be minimised. As a result, a decrease in the yield- or strength limit caused by hydrogen, or a decrease in the supportable alternating stresses (fluctuating stress) is counteracted. In addition, by means of the method according to the invention, the effect of inhibitors which are not usable or inadequate during some manufacturing steps of the electroplating is compensated for. Essentially also costly (since associated with significant energy use) heat treatments which entail the danger of inadmissible structure effects or component distortion are superfluous. Furthermore, it should be taken into account that the intrinsic stresses produced according to the state of the art, which were produced in the aim of compensating for operating stresses, can be reduced during cyclic component stress and hence lose their effect. The structural modifications and hydrogen traps produced according to the invention are however not hereby affected.

A preferred embodiment of the method according to the invention is distinguished by it being determined or estimated before step a) what volume of hydrogen will penetrate into the mechanically treated edge layer during the electrodeposition in step b), and the mechanical treatment being effected in step a) such that the total volume of the hydrogen traps produced in the modified portions of the edge layer is greater than or equal to the volume of hydrogen determined or estimated before step a). In this way, it is possible for example to achieve that the hydrogen traps produced in the modified portions of the edge layer essentially bind the totality of the hydrogen penetrating into the mechanically treated edge layer during the electrodeposition in step b). Determination of the volume of the hydrogen penetrating into the mechanically treated edge layer during the electrodeposition in step b) can be effected for example by means of thermal desorption spectroscopy (TDS) or by means of heat extraction. In particular it is possible, by means of TDS testing of a component in which in fact hydrogen has penetrated, to differentiate between the hydrogen which is trapped in hydrogen traps and the hydrogen which is not trapped in hydrogen traps, i.e. present free or diffusible.

Testing or detection of the structural modifications in the edge layer can be effected for example by means of X-ray diffraction measurements or transmission electron microscopy.

In a further preferred variant of the method according to the invention, the mechanical treatment in step a) is effected by shot peening, by deep rolling, by rolling, by hammering, by removing material by machining, preferably grinding, turning, milling, or by a combination hereof.

A further preferred variant of the method according to the invention is distinguished by the component to be coated comprising a crystalline material or consisting thereof, which is selected preferably from the group consisting of metals, semimetals, ceramics and mixtures hereof.

Preferably, the component to be coated comprises a material which is selected from the group consisting of metals, semimetals, ceramics and mixtures hereof, or consists hereof.

According to a further preferred variant of the method according to the invention, the coating (which is electrodeposited in step b)) is a coating made of a metal or of a metal alloy, the metal and/or the metal alloy being selected preferably from the group consisting of gold, silver, iron, chromium, nickel, copper, cadmium, palladium, zinc or mixtures and alloys hereof.

A further preferred variant of the method according to the invention is characterised in that, during the mechanical treatment in step a), the structure of the edge layer is modified, at least in portions, to a depth of more than 0.01 mm, preferably of more than 0.1 mm, particularly preferably of more 0.2 mm, and hydrogen traps are produced in the modified portions of the edge layer. The greater the depth to which the edge layer is modified and to which the hydrogen traps in the edge layer are produced, the more can the hydrogen penetrating into the edge layer generally be trapped. It is hereby important that, when choosing a greater depth, the risk can be minimised that the hydrogen diffusing into the edge layer passes through the modified region with the hydrogen traps without being trapped in the hydrogen traps. In addition, it should also be taken into account that, in the case of a greater depth, also the volume of the modified region is enlarged and hence hydrogen traps can be produced within a greater volume, for which reason, also the total volume of the hydrogen traps can be greater.

A further preferred variant of the method according to the invention is distinguished by it being determined or estimated, before step a), to what depth the hydrogen will penetrate into the mechanically treated edge layer during the electrodeposition in step b), and the mechanical treatment in step a) is effected such that the hydrogen traps produced in the edge layer are produced at least in the portions, the surface of which is intended to be coated in step b), to this depth determined or estimated before step a). In this way, it can be prevented or at least the risk can be minimised significantly that the hydrogen diffusing into the edge layer passes through the modified region with the hydrogen traps without being trapped in the hydrogen traps.

It is particularly preferred that the determination of the depth is effected before step a) by the surface of the edge layer of a further component which consists of the same material as the component to be coated, being provided with an electroplating, at least in portions, which consists of the same material as the electroplating in step b) and, directly thereafter, the depth course of the hydrogen content in the edge layer being analysed, this being effected preferably by means of secondary ion mass spectrometry (SIMS) and/or glow discharge spectroscopy (GDOES).

According to a further preferred variant of the method according to the invention, after step a) and before step b), a chemical, preferably electrochemical, pre-treatment of the surface of the component to be coated is implemented. The chemical pre-treatment of the surface of the component to be coated is thereby selected preferably from the group consisting of de-greasing the surface, etching the surface, pickling the surface, activating the surface and also a combination of these pre-treatments.

The present invention also relates to an electroplated component which is producible or was produced with the method according to the invention. This component hence has, at least in portions of an edge layer which abuts on the electroplating, structural modifications and hydrogen traps.

Testing or detecting the structural modifications in the edge layer of the component according to the invention can be effected for example by means of X-ray diffraction measurements or transmission electron microscopy. Also the extent of the structural modification can be estimated herewith. Detection of the hydrogen traps, the binding energies thereof or a measurement of the volume of the hydrogen traps is possible by means of thermal desorption spectroscopy (TDS).

The component according to the invention differs inter alia from already known electroplated components from the state of the art by the component, at least in portions of an (edge) layer abutting on the electroplating, having a plurality of hydrogen traps and in addition, essentially the totality of the (atomic and/or molecular) hydrogen which is present in the electroplated component being bound in hydrogen traps which are situated in the modified portions of an (abutting on the electroplating) edge layer of the component. This means that either absolutely no or at most only a very small proportion of (atomic and/or molecular) hydrogen is present free in the component. The concentration of the hydrogen present free in the component (i.e. not bound in hydrogen traps) is thereby preferably at most 2 ppm, particularly preferably at most 1 ppm, very particularly preferably at most 0.5 ppm. As a result of the fact that essentially the totality of the (atomic and/or molecular) hydrogen present in the component is bound in the hydrogen traps which are situated in the modified portions of the edge layer, this hydrogen can cannot penetrate further into the component, but rather remains in the edge layer. In other words, it can hence be achieved that, in the central regions crucial for the stability of the component, no (atomic and/or molecular) hydrogen is present. As a result of the significant reduction in diffusible hydrogen in the component, the danger of hydrogen embrittlement is hence significantly reduced. As a result, the component has less of a tendency towards brittle failure or has higher longevity. These advantages can be attributed directly to the production method according to the invention.

A preferred embodiment of the electroplated component according to the invention is distinguished by the concentration or the proportion of the (atomic and/or molecular) hydrogen which is present in the electroplated component and not bound in the hydrogen traps, being at most 2 ppm, preferably at most 1 ppm, particularly preferably at most 0.5 ppm.

A further preferred embodiment of the component according to the invention is characterised in that the component (outside the electroplating) comprises a crystalline material or consists thereof, which is selected preferably from the group consisting of metals, semimetals, ceramics and mixtures hereof.

Preferably, the component (outside the electroplating) comprises a material which is selected from the group consisting of metals, semimetals, ceramics and mixtures hereof or consists hereof.

According to a further preferred embodiment of the component according to the invention, the coating is a coating made of a metal or a metal alloy, the metal and/or the metal alloy being selected preferably from the group consisting of gold, silver, iron, chromium, nickel, copper, cadmium, palladium, zinc and also mixtures and alloys hereof.

The present invention also relates to the use of the electroplated component according to the invention as fixing part, e.g. screw, as supporting bodywork component, as roller- and/or sliding bearing, as component of drilling rods in oil- and gas extraction, as component of gas containers or gas pipes and/or as component of aircraft landing gear.

The present invention is intended to be explained in more detail with reference to the subsequent examples without restricting said invention to the specific embodiments and parameters shown here.

EMBODIMENT 1

The first embodiment relates to the avoidance of hydrogen embrittlement of a hardened steel after electroplating by machining-caused increase in the trap density.

In this case, the application of the present invention for embrittlement-proof electrodeposition of a thin (<50 μm) hard chromium layer on a hardened steel sample is illustrated. The steel sample was hard-turned with machining parameters which were chosen from the point of view of economic machining.

Firstly, the edge layer state is characterised by means of X-ray analyses. Normal hard-machining parameters are associated with high heat effect and the formation of unfavourable intrinsic tensile stresses, the predominant heat influence does not lead to a significantly increased trap density.

This sample is coated with hard chromium according to the state of the art, which leads to a hydrogen input.

Directly after the coating, the hydrogen depth profile is determined by means of GDOES (Glow Discharge Emission Spectroscopy). Because of the low layer thickness and the short coating time, only a near-surface hydrogen input up to approx. 0.1 mm can be expected. Furthermore, the proportion of bound hydrogen is determined by TDS.

As a result of changed parameters of the hard-turning on a further sample, the dislocation density and hence the trap density in the edge layer is increased.

In a further coating test on this sample, the binding of the hydrogen in the edge layer treated according to the invention is examined by means of GDOES and, by means of TDS, the predominant binding of the hydrogen and the small degree of residual diffusible hydrogen is ensured.

EMBODIMENT 2

The second embodiment relates to the avoidance of hydrogen embrittlement of a hardened steel after electroplating by increasing the trap density by means of hammering.

In this case, the application of the invention for embrittlement-proof electrodeposition of a thick (>100 μm) hard chromium layer on a hardened steel sample is presented.

Firstly, the edge layer state is characterised by means of X-ray analyses. Without a strengthening surface treatment, such as shot peening, hammering or deep rolling, increased dislocation- or trap densities can generally be attributed to the metal-removing end machining with effect depths<0.2 mm. A sample is coated according to the state of the art with a thick hard chromium layer, as is often used for wear-protection purposes, which leads to a significant and deep-reaching hydrogen input.

A deep-reaching hydrogen input cannot be determined by means of GDOES, the analysis depth of GDOES is generally restricted to 0.1 mm. For this reason, thin sample strips are removed from the edge of the sample, below the coating, and the total hydrogen content is determined by means of hot extraction and the non-bound hydrogen component by means of TDS. As a result, a hydrogen input can also be demonstrated in greater depths.

By hammering, a further sample is surface-treated. Increased dislocation densities up to several millimetres depth can thereby be achieved and demonstrated by means of X-ray diffraction.

After the electroplating of this sample, the binding of the hydrogen in the edge layer treated according to the invention is tested by means of TDS and hot extraction.

The invention claimed is:

1. A method for producing electroplated components, in which a) an edge layer of a component to be coated is subjected to a mechanical treatment, in which the edge layer is deformed at least in portions, consequently the structure of the edge layer being modified at least in portions and, in the modified portions of the edge layer, hydrogen traps being produced, and b) at least on a part of the surface of the mechanically treated edge layer of the component to be coated, a coating is electrodeposited, hydrogen being released during the electrodeposition which penetrates into the mechanically treated edge layer at least partially, the hydrogen traps produced in the modified portions of the edge layer essentially binding the totality of the hydrogen penetrating into the mechanically treated edge layer during the electrodeposition in step b);

wherein it is determined or estimated before step a) what volume of hydrogen will penetrate into the mechanically treated edge layer during the electrodeposition in step b), and the mechanical treatment in step a) is effected such that the total volume of the hydrogen traps produced in the modified portions of the edge layer is greater than or equal to the volume of hydrogen determined or estimated before step a).

2. The method according to claim 1, wherein the mechanical treatment in step a) is effected by shot peening, by rolling, by hammering, by material-removing machining, or by a combination thereof.

3. The method according to claim 1, wherein the component to be coated comprises a crystalline material.

4. The method according to claim 3, wherein the crystalline material is selected from the group consisting of metals, semimetals, ceramics and mixtures thereof.

5. The method according to claim 1, wherein the coating is a coating made of a metal or of a metal alloy, the metal and/or the metal alloy being selected from the group consisting of gold, silver, iron, chromium, nickel, copper, cadmium, palladium, zinc, and mixtures and alloys thereof.

6. The method according to claim 1, wherein, during the mechanical treatment in step a), the structure of the edge layer is modified, at least in portions, to a depth of more than 0.01 mm, and hydrogen traps are produced in the modified portions of the edge layer.

7. The method according to claim 1, wherein it is determined or estimated, before step a), to what depth the hydrogen will penetrate into the mechanically treated edge layer during the electrodeposition in step b), and the mechanical treatment in step a) is effected such that the hydrogen traps produced in the edge layer are produced at least in the portions, the surface of which is intended to be coated in step b), to this depth determined or estimated before step a).

8. The method according to claim 7, wherein the determination of the depth is effected before step a) by the surface of the edge layer of a further component which consists of the same material as the component to be coated, being provided with an electroplating, at least in portions, which consists of the same material as the electroplating in step b) and, directly thereafter, by the depth course of the hydrogen content in the edge layer being analysed.

9. The method according to claim 1, wherein, after step a) and before step b), a chemical pre-treatment of the surface of the component to be coated is implemented, the chemical pre-treatment of the surface of the component to be coated being selected from the group consisting of de-greasing the surface, etching the surface, pickling the surface, activating the surface and a combination thereof.

10. A method for producing electroplated components, in which a) an edge layer of a component to be coated is subjected to a mechanical treatment, in which the edge layer is deformed at least in portions, consequently the structure of the edge layer being modified at least in portions and, in the modified portions of the edge layer, hydrogen traps being produced, and b) at least on a part of the surface of the mechanically treated edge layer of the component to be coated, a coating is electrodeposited, hydrogen being released during the electrodeposition which penetrates into the mechanically treated edge layer at least partially, the hydrogen traps produced in the modified portions of the edge layer essentially binding the totality of the hydrogen penetrating into the mechanically treated edge layer during the electrodeposition in step b);

wherein it is determined or estimated, before step a), to what depth the hydrogen will penetrate into the mechanically treated edge layer during the electrodeposition in step b), and the mechanical treatment in step a) is effected such that the hydrogen traps produced in the edge layer are produced at least in the portions, the surface of which is intended to be coated in step b), to this depth determined or estimated before step a).

11. The method according to claim 10, wherein the determination of the depth is effected before step a) by the surface of the edge layer of a further component which consists of the same material as the component to be coated, being provided with an electroplating, at least in portions, which consists of the same material as the electroplating in step b) and, directly thereafter, by the depth course of the hydrogen content in the edge layer being analysed.

12. The method according to claim 10, wherein the mechanical treatment in step a) is effected by shot peening, by rolling, by hammering, by material-removing machining, or by a combination thereof.

13. The method according to claim 10, wherein the component to be coated comprises a crystalline material.

14. The method according to claim 13, wherein the crystalline material is selected from the group consisting of metals, semimetals, ceramics and mixtures thereof.

15. The method according to claim 10, wherein the coating is a coating made of a metal or of a metal alloy, the metal and/or the metal alloy being selected from the group consisting of gold, silver, iron, chromium, nickel, copper, cadmium, palladium, zinc, and mixtures and alloys thereof.

* * * * *